US007210683B2

(12) United States Patent
Ko et al.

(10) Patent No.: US 7,210,683 B2
(45) Date of Patent: May 1, 2007

(54) 2 THROUGH 6 MAIN BET

(76) Inventors: Shenli Ko, P.O. Box 82225, Las Vegas, NV (US) 89180; Kenneth J. Brunelle, P.O. Box 82257, Las Vegas, NV (US) 89180

( * ) Notice: Subject to any disclaimer, the term of this patent is extended or adjusted under 35 U.S.C. 154(b) by 237 days.

(21) Appl. No.: 10/974,112

(22) Filed: Oct. 27, 2004

(65) Prior Publication Data

US 2006/0087079 A1 Apr. 27, 2006

(51) Int. Cl.
*A63F 1/00* (2006.01)

(52) U.S. Cl. ..... 273/274; 463/12

(58) Field of Classification Search ..... 273/274; 463/12

See application file for complete search history.

(56) References Cited

U.S. PATENT DOCUMENTS 5,328,189 A * 7/1994 Malek ..... 273/292
5,799,946 A * 9/1998 Groussman ..... 273/292
5,979,897 A 11/1999 Grossman
6,293,551 B1 9/2001 Webb
6,341,778 B1 * 1/2002 Lee ..... 273/292
6,422,565 B1 7/2002 Daines
6,604,741 B1 8/2003 Snow

* cited by examiner

*Primary Examiner*—Vishu K Mendiratta
(74) *Attorney, Agent, or Firm*—Robert Ryan Morishita; Morishita Law Firm, LLC

(57) ABSTRACT

A method for playing an improved game of Blackjack is set forth. Instead of the traditional 3-to-2 odds or the new 6-to-5 odds, the game of the invention pays different odds for a player's blackjack. The dealer's face-up card is used in determining how much a player's blackjack should be paid. The invention eliminates the need for 50¢ coins, lessens Blackjack's vulnerability to advantage play of card counting and pays higher odds to add excitement. In one of the embodiments the dealer is allowed a maximum of five cards per round.

21 Claims, 1 Drawing Sheet

2 THROUGH 6 MAIN BET

BACKGROUND OF THE INVENTION

This invention refers generally to a method of playing a card game and specifically to the game of Blackjack or 21.

Blackjack is one of the most popular casino games in the world today. The majority of all table games in most casinos are Blackjack tables. Even though Blackjack does not have the most generous house advantage, popularity of the game becomes an important factor in the distribution of floor space.

Blackjack is a card game in which players play against the dealer. In traditional Blackjack the player must first place his initial wager, the main bet, before any cards are dealt. The casino management will set the minimum and maximum limits for their establishments. Smaller casinos may have a lower maximum limit than a larger casino. A table sign is posted to let the public know what the limits are on a particular table. Players can vary in the amount bet each round as long as they stay within the boundaries of the table limit.

In traditional Blackjack, after all players have made their bets, each player is dealt two cards from one or more decks of 52 cards, both face-up as seen in multiple deck games or both face-down as seen in single and double deck games. The dealer is also dealt two cards, one face-up and one face-down. The face-up card is called the dealer's up card and the face-down card is the hole card that won't be revealed until all players play out their hands. In some European casinos, the dealer will not receive a second card until all players play out their hands.

Throughout time the rules of Blackjack have pretty much stayed the same. In Blackjack each playing card is assigned a count value. 2s through 9s count as their value, 10s and all face cards count as 10, and aces count as 1 or 11. The object is to beat the dealer's hand by reaching a total count value closest to 21 without exceeding 21. Based upon the initial two cards, the player may stand anytime, hit for more additional cards, double down and get one more card, or split any pair. Although the player may hit his hand until the desired point total has been achieved, if the player's point total goes over 21, the player is said to bust and will lose his bet immediately. Most players use the dealer's up card as a guide to stand or hit. The dealer must hit until his point total is at least 17. When the dealer has acquired 17 or greater, the dealer's hand is final. If the dealer's point total goes over 21, the dealer is said to bust and all players remaining in the game will win. The winning player is paid even money. However, if a player receiving a blackjack or "natural" in his first two cards, he usually is paid 3 to 2 if the dealer does not also have a blackjack. A blackjack is defined as the combination of any ace and any 10-value card in the original first two cards dealt.

Blackjack has been known for its low house edge, which is conducive to its popularity. In traditional Blackjack a player's blackjack is paid 3 to 2 (1.5 to 1) and the house edge is about 0.5%. However, a recent trend is toward paying blackjacks at 6 to 5 (1.2 to 1) odds or even 1 to 1. That raises the house edge to 1.5% or more. The casinos that pay less than 3 to 2 for a blackjack wish not only to increase their profit, but also to thwart card counting since traditional Blackjack can be beat by counting high and low cards as they are dealt out. Although it helps deter card counting, the much higher house edge hurts the majority of the players who don't count cards. Since the advent of the 6-to-5 Blackjack, many gaming experts and Blackjack players have condemned it as a rip-off and therefore have avoided such games.

On the other hand, there also is a drawback to 3-to-2 Blackjack. Since the payoff odds are not integral, 50¢ coins or chips are indispensable in order to pay off a player's blackjack. For example, a $5 bet is paid $7.50. Some casinos even use $2.50 chips in the hopes of expediting the dealing of the game. The 50¢ or $2.50 chips not only add to the casino's cost but also slow the game down. Imagine a dealer paying off a blackjack on a bet of $37.50! Moreover, if the player bets all the 50¢ coins they have received, it will bring the dealer more work because most dealers would try to collect the 50¢ coins when making a payment. For example, if a player bets $7.50 and wins, the dealer would pay the player $10 and take the $2.50 back so that the player cannot bet $2.50 anymore.

U.S. Pat. No. 5,979,897 discloses a variation of Blackjack wherein a player blackjack in a specified suit pays 2 to 1 and all other blackjacks pay 1 to 1. Also, the player may place a side bet on his getting a blackjack in a designated suit (e.g., diamonds) that pays 300 to 1.

U.S. Pat. No. 6,293,551 discloses a Blackjack game that provides a player insurance wagering option when a dealer first card is either an Ace or a ten-value card. An additional wagering option is provided when a player first card is either an Ace or a ten-value card that the player two-card total will be 21. Payouts for the respective wagers are varied according to whether the dealer or player first card is the Ace or the ten-value card and whether the two-card twenty-one is comprised of cards of a predefined relation such as same suit or color or cards including a 10-value card of a particular rank.

U.S. Pat. No. 6,422,565 discloses a method of playing a Blackjack variation wherein the dealer, instead of hitting his hand until it is 17 or greater, will hit until his hand beats the player's or busts. A player's blackjack is paid 1 to 1 unless it is suited, in which case it is paid 2 to 1.

U.S. Pat. No. 6,604,741 discloses a method of playing a Blackjack variation wherein a player's blackjack is paid 1 to 1, except where the player's blackjack is a one-suited blackjack, which is paid at a rate of greater than 1 to 1.

The aforementioned Blackjack variations either require the player to make an additional wager or introduce more liberal rules to entice more play, such as doubling down on two or more cards, surrender after doubling down and a 6-card automatic winner. These liberal rules do not come without a price, however. As the house edge on traditional Blackjack is very low, typically between 0.2% and 0.6%, player blackjacks must be paid even money instead of 3 to 2 to compensate for the loss of the casino's edge due to the liberal rules. The probability of getting an uncontested blackjack is about, 4.6%. By paying 1 to 1 instead of 3 to 2 on a player blackjack, the house gets an additional 2.3% edge (4.6%×0.5). For every four blackjacks dealt there will be one suited blackjack and for every 16 blackjacks dealt there will be one blackjack of a specific suit, e.g., Diamonds. While paying 2 to 1 for a suited blackjack reduces the house's additional 2.3% edge by ½, paying 2 to 1 for a blackjack of a specific suit only reduces it by ⅛. So, despite the liberal rules added, these Blackjack variations still have a higher house edge than does traditional Blackjack, and they won't mitigate the card counting threat without hurting the majority of the players who don't count cards.

Furthermore, traditional 3-to-2 Blackjack, unfortunately, "helps" make card counting more lucrative. A card counter raises his bet when the remaining deck is in his favor and reduces his bet when it is in the house's favor. The reason card counting for Blackjack works is obvious. When the deck is rich in high cards, even though both the dealer and player have an equal chance of receiving a 20 or a blackjack, (a) a player blackjack is paid 3 to 2, (b) the dealer hand, if not 17 or greater, must draw and can bust easily whereas the player can stand on a 15 and 16, and (c) the player can vary his draw, double and split strategy to take advantage of the situation. Among the rest, the 3-to-2 blackjack payoff contributes vastly to the card counter's profitability.

The present invention not only matches the payback which traditional 3-to-2 Blackjack can yield to give the player a fair shake, but it also:

obviates the need for 50¢ coins or $2.50 chips, lessens Blackjack's vulnerability to advantage play of card counting, and pays higher odds up to 6 to 1 to add excitement.

SUMMARY OF THE INVENTION

The wagering card game of the present invention is a variation of Blackjack and is played with one or more decks of cards. Each player enters the game by placing an initial bet in the space provided on the playing surface or layout. The dealer will deal two cards to each player and himself. Following the casino's rules of Blackjack, the player can stand, draw additional cards, double down or split a pair. As in regular Blackjack, the dealer then compares his hand with each player's hand and collects or pays each player's bet.

In the present invention, a player's blackjack is paid, instead of 3 to 2, at different odds, depending on the value of the dealer's face-up card. One embodiment of the invention is as follows:

Blackjack Pay Table A

| Dealer's Face-Up Card | Pays |
|---|---|
| 6 | 3 to 1 |
| 2 through 5 | 2 to 1 |
| Any Card but 2 through 6 | 1 to 1 |

Although the player blackjack is paid 3 to 1 only when the dealer's face-up card is a 6, it can be one of any 2 though 5 as shown in pay table B below:

Blackjack Pay Table B

| Dealer's Face-Up Card | Pays |
|---|---|
| 5 | 3 to 1 |
| 2, 3, 4 or 6 | 2 to 1 |
| Any Card but 2 through 6 | 1 to 1 |

Another embodiment of the invention is as follows:

Blackjack Pay Table C

| Dealer's Face-Up Card | Pays |
|---|---|
| 6 of Hearts | 6 to 1 |
| 2 through 6 | 2 to 1 |
| Any Card but 2 through 6 | 1 to 1 |

Although the 6 of Hearts is shown in Pay Table B, it can be a 6 of any other suit. As in regular Blackjack, a player's blackjack is paid only when the dealer does not have a blackjack.

DETAILED DESCRIPTION OF THE INVENTION

Brief Description of the Drawing

Referring to FIG. 1, the casino game of the present invention, referred to herein as "2 Thru 6 Blackjack Main Bet," is a card game played on a playing surface 10. The playing surface is a felt covering the top of the gaming table. The present invention may also be played on a video screen or computer with cards being simulated and one or more players participating through a video station. Displayed on the playing surface 10 is a dealer position 12. Player positions 14 are located across from the dealer's position 12. The number of player positions may vary but most casinos will display seven positions, all identical. The players place their bet in betting circles 18.

Figure 1:
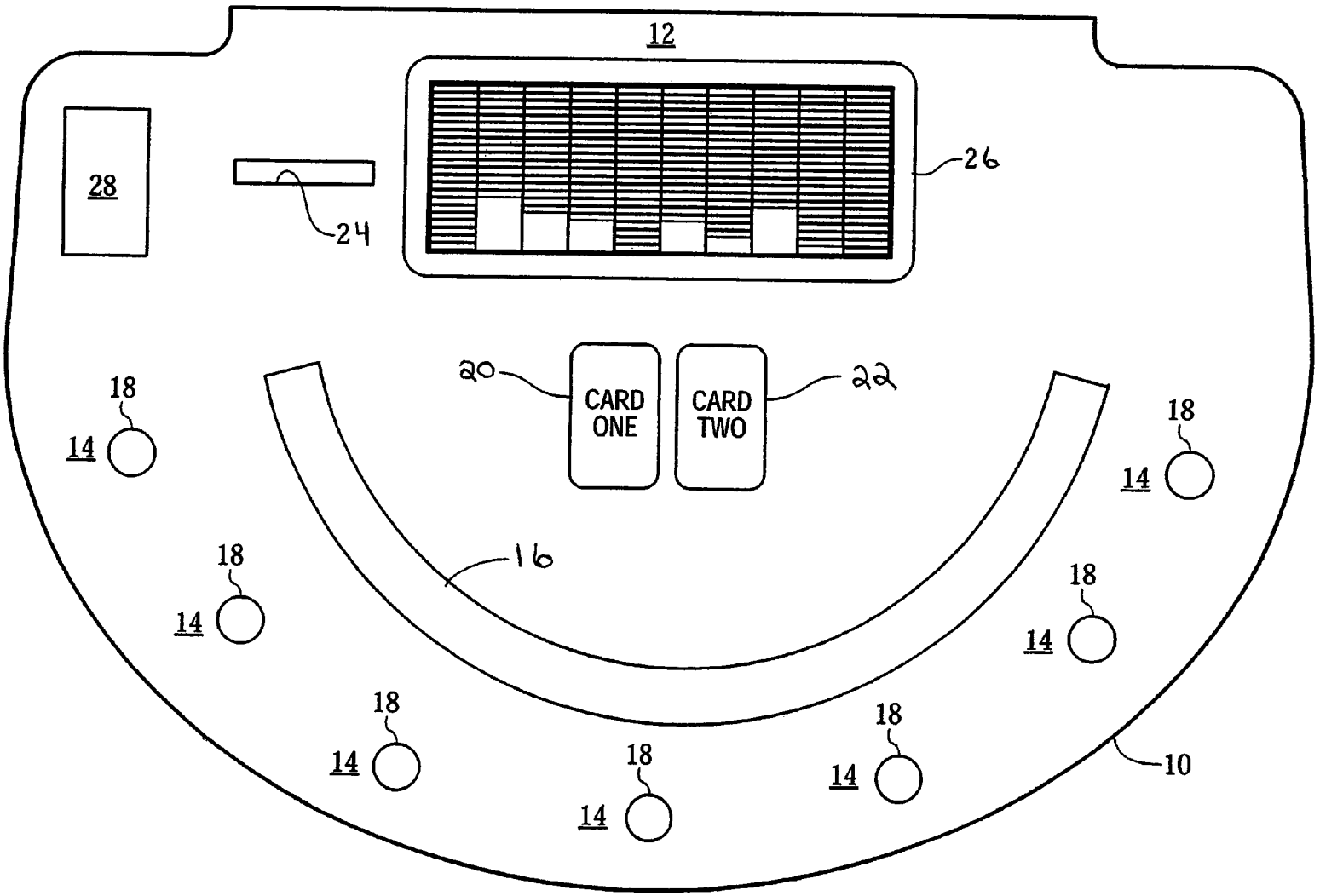
FIG. 1 illustrates a typical casino gaming table layout used in the wagering game of the present invention.

An information area 16 is located between the dealer's station and the player's stations. Casino management determines what information will be displayed but most state "Insurance pays 2 to 1." A new rule of the present invention which states "Dealer must stand on fifth card" could be displayed in position 16.

Betting areas 18 are displayed at each player position 14 and vary in design depending on casino preference. The most widely used design is a standard circle. At the beginning of each round, all players will place their bets inside the boarders of their corresponding betting area 18. All bets must remain within the betting limits which are determined by casino management.

Referring again to FIG. 1, on the dealer's immediate right is a money drop slot 24. Below the drop slot, under the table is a drop box in which the proceeds of a particular casino shift are deposited. In front of the dealer is the casino's chip tray 26 and also to the right of the dealer is a card discard tray which is usually positioned in front of the drop slot.

After all bets have been placed, each player is dealt two cards from one or more decks of 52 cards, both face-up as seen in multiple deck games or both face-down as seen in single and double deck games. The cards are placed in front of each player position 14. The dealer is also dealt two cards, one face-up and one face-down. The face-up card is called the dealer's up card or card one 20. The dealer's face-down card is the hole card or card two 22. The hole card will not be revealed until all players play out their hands.

Following the rules of traditional Blackjack, if the player receives a natural blackjack and the dealer does not, the player will receive a traditional payout of 3 to 2. A "blackjack" is defined as the combination of any Ace and any 10-value card in the original dealt hand of two cards.

The benefits of the invention are three-fold. First of all, even though the payoff odds for blackjacks vary, the invention still gives the player a fair shake by paying back or returning to the player almost 100% of what traditional 3-to-2 Blackjack pays back. For comparison purposes, below is a chart that illustrates the probability of getting an uncontested blackjack and its return in a single deck Blackjack for both the invention and traditional 3-to-2 Blackjack:

| Dealer's Face-Up Card | % Probability of a Player's Uncontested Blackjack | The Invention Pay | The Invention % Return | Traditional Blackjack Pay | Traditional Blackjack % Return |
|---|---|---|---|---|---|
| 6 | 0.3861 | 3 | 1.1584 | 1.5 | 0.5792 |
| 2 thru 5 | 1.5445 | 2 | 3.0890 | 1.5 | 2.3167 |
| Ace | 0.2009 | 1 | 0.2009 | 1.5 | 0.3014 |
| Any 10-value card | 1.3593 | 1 | 1.3593 | 1.5 | 2.0390 |
| Any 7 thru 9 | 1.1584 | 1 | 1.1584 | 1.5 | 1.7376 |
| Total | 4.6492 | | 6.9660 | | 6.9739 |

Since the difference in the percentage of return between the invention (6.966%) and traditional 3-to-2 Blackjack (6.9739%) is a mere 0.0079%, the invention remains a fair game to Blackjack players. So, the casinos need not worry about losing their Blackjack players.

Secondly, since all payoff odds of the invention are integral, there will be no fractional payoffs such as $7.50. So, there is no need for 50¢ coins or $2.50 chips. That makes the dealer's job easier and the game faster.

Thirdly, the casino's vulnerability to card counting is lessened. One of the major reasons why a card counter can gain an edge over the house dealer is that the player is paid 3 to 2 for his blackjack and the dealer is not. So, even though both the player and the dealer have an equal chance of receiving a blackjack at any time, the additional 50% payoff for a player's blackjack enables the card counter to win more by betting more when the remaining deck is rich in 10s and Aces. The invention mitigates the drawback by paying (a) just 1 to 1 when the dealer has a high face-up card and (b) higher odds when the dealer has a low face-up card of any 2 through 6. As a result, the card counter's advantage at high counts will be vastly reduced since the dealer needs a low face-up card for the counter to be paid higher odds for his blackjack. Thus, there exists a conflict of interest. When the remaining deck is rich in high cards such as 10s and Aces, the dealer tends to have a high face-up card, which results in a player's blackjack being paid just even money. According to the results of our computer simulations using a popular Blackjack card counting system called the "High-Low" count (see *Professional Blackjack* by Stanford Wong, Pi Yee Press), the well designed payoff odds for blackjacks of the invention can reduce the card counter's profitability from 15% for a double deck to 51% for a six-deck Blackjack. The casinos using this invention will be less vulnerable to card counting and won't hurt those players who are not card counters.

In another preferred embodiment of the present invention, the dealer's hand is limited to a maximum of five cards. Instead of hitting his hand until he gets 17 or better, the dealer must stop when the number of cards in his hand reaches 5. Thus, there are times when the dealer will end up with a point total of less than 17. In regular Blackjack a player receiving a "stiff" hand of 12 through 16 would stand versus a dealer's face-up card of any 2 through 6. (The only two exceptions are a player 12 versus a 2 or 3 up.) Thus the player can win with a stiff only if the dealer busts since the dealer's hand will always be 17 or greater otherwise. This invention allows the player to win with a stiff even if the dealer does not bust. For example, if the player has 15 and the dealer ends up with a five-card 14 (e.g., 5, 4, 2, A, 2), the player will win. This has never been possible or seen in the table game of traditional Blackjack. Therefore, the dealer's 5-card limit rule would add more fun to the play of Blackjack.

The invention also can be incorporated into electronic Blackjack games. For example, for a traditional video Blackjack machine with a bet denomination of 5¢ or 25¢, it is impossible to pay 3 to 2 when the player is dealt a blackjack unless the payoff is rounded up or off. With this invention, it is possible.

While we have described certain embodiments of the present invention, it should be understood that it is subject to modifications and changes which do not depart from the spirit and scope of the invention. For example, the payoff odds can vary depending on the dealer's face-up card. Also, the invention can be used in existing variants of blackjack such as Super Fun 21, Spanish 21, Pontoon and No Bust 21.

The invention claimed is:

1. An improved method for conducting a card game played between a dealer and at least one player according to the conventional rules of Blackjack utilizing playing cards, or electronic representations thereof, where Jacks, Queens, and Kings are counted as ten, Aces are counted as one or eleven, and all other cards are counted as face value, in which each player makes an initial wager, the dealer randomly distributes an initial player hand of two cards, or electronic representations thereof, to each player and at least one card, or electronic representation thereof, to the dealer, the improved method comprising the steps of:

defining a pay table for traditional blackjack hands comprising an initial hand of one ace and one ten-value card, said pay table including at least two different payouts for traditional blackjack hands such that a player is rewarded a first payout for obtaining a traditional blackjack when the dealer receives a face-up card contained in a first set and a second payout different from said first payout for obtaining a traditional blackjack when the dealer receives a face-up card contained in a second set;

examining said initial player hand for a traditional blackjack hand;

rewarding each player having a traditional blackjack according to said pay table and said player's initial wager; and for each player not having a traditional blackjack hand, forming a final hand according to said conventional rules of Blackjack.

2. The method of claim 1 wherein said first set and said second set are mutually exclusive.

3. The method of claim 1 wherein said first set comprises one or more of the cards Ace, seven, eight, nine, ten, Jack, Queen, and King.

4. The method of claim 1 wherein said second set comprises one or more of the cards two, three, four, five, six, and seven.

5. The method of claim 1 wherein said first payout is even money.

6. The method of claim 1 wherein said second payout is greater than even money.

7. The method of claim 1 further comprising a third payout greater than even money and different from said second payout, said third payout rewarded to a player for obtaining a traditional blackjack when the dealer receives a card contained in a third set.

8. The method of claim 7 wherein said third set comprises at least a six card.

9. The method of claim 1 further comprising the dealer forming a final hand by receiving additional cards until the sum of the dealer's cards is seventeen or greater.

10. The method of claim 9 wherein said dealer may receive no more than three additional cards without regard to the sum of the dealer's cards.

11. An improved method for conducting a card game played between a dealer and at least one player according to the conventional rules of Blackjack utilizing playing cards, or electronic representations thereof, where Jacks, Queens, and Kings are counted as ten, Aces are counted as one or eleven, and all other cards are counted as face value, in which each player makes an initial wager, the dealer randomly distributes an initial player hand of two cards, or electronic representations thereof, to each player and at least one card, or electronic representation thereof, to the dealer, the improved method comprising the steps of:

defining a pay table for traditional blackjack hands comprising an initial hand of one ace and one ten-value card, said pay table including at least two different payouts for traditional blackjack hands such that a player is rewarded a first payout of even money for obtaining a traditional blackjack when the dealer receives a face-up card contained in a first set and a second payout of greater than even money for obtaining a traditional blackjack when the dealer receives a face-up card contained in a second set mutually exclusive of said first set;

examining said initial player hand for a traditional blackjack hand;

rewarding each player having a traditional blackjack according to said pay table and said player's initial wager; and for each player not having a traditional blackjack hand, forming a final hand according to said conventional rules of Blackjack.

12. The method of claim 11 wherein said first set comprises one or more of the cards Ace, seven, eight, nine, ten, Jack, Queen, and King.

13. The method of claim 11 wherein said second set comprises one or more of the cards two, three, four, five, six, and seven.

14. The method of claim 11 further comprising a third payout greater than even money and different from said second payout, said third payout rewarded to a player for obtaining a traditional blackjack when the dealer receives a card contained in a third set.

15. The method of claim 14 wherein said third set comprises at least a six card.

16. The method of claim 11 further comprising the dealer forming a final hand by receiving additional cards until the sum of the dealer's cards is seventeen or greater, but wherein said dealer may receive no more than three additional cards without regard to the sum of the dealer's cards.

17. A method for conducting a card game played between a dealer and at least one player utilizing playing cards, or electronic representations thereof, where Jacks, Queens, and Kings are counted as ten, Aces are counted as one or eleven, and all other cards are counted as face value, the method comprising:

defining a pay table for traditional blackjack hands comprising an initial hand of one ace and one ten-value card, said pay table including at least three different payouts for traditional blackjack hands such that a player is rewarded a first payout of even money for obtaining a traditional blackjack when the dealer receives a card contained in a first set, a second payout of greater than even money for obtaining a traditional blackjack when the dealer receives a face-up card contained in a second set mutually exclusive of said first set, and a third payout of greater than even money for obtaining a traditional blackjack when the dealer receives a card contained in a third set mutually exclusive of said second set and said first set;

each player making an initial wager;

randomly distributing an initial player hand of two cards to said player and at least one exposed card to said dealer;

examining said initial player hand for a traditional blackjack hand;

rewarding each player having a traditional blackjack according to said pay table and said player's initial wager; and for each player not having a traditional blackjack hand, forming a final hand by receiving additional cards until the player stands on a final hand or the sum of the values of the player's cards exceeds twenty-one;

said dealer forming a final hand by receiving additional cards until the dealer stands on a final hand of seventeen or greater, or the sum of the values of the dealer's cards exceeds twenty-one; and resolving each player's initial wager by comparing the player's final hand to the dealer's final hand and rewarding the player if the sum of the values of the dealer's cards exceeds twenty-one, or if the sum of the values of the player's cards is closer to twenty-one than the sum of the values of the dealer's cards is.

18. The method of claim 17 wherein said first set comprises the cards Ace, seven, eight, nine, ten, Jack, Queen, and King.

19. The method of claim 17 wherein said second set comprises the cards two, three, four, and five.

20. The method of claim 17 wherein said third set comprises the card six.

21. The method of claim 17 wherein said dealer may receive no more than three additional cards without regard to the sum of the dealer's cards.

* * * * *